US005993200A

United States Patent [19]

Palmer-Jones

[11] Patent Number: 5,993,200

[45] **Date of Patent: *Nov. 30, 1999**

[54] FUEL FIRED BURNERS

[75] Inventor: Roland Vincent Horatio Palmer-Jones, Nottingham, United Kingdom

[73] Assignee: British Gas plc., London, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/663,410

[22] Filed: Jun. 13, 1996

[30] Foreign Application Priority Data

Jun. 15, 1995 [GB] United Kingdom ..... 9512192

[51] Int. Cl.[6] ..... F23D 14/12

[52] U.S. Cl. ..... 431/328

[58] Field of Search ..... 431/328

[56] References Cited

U.S. PATENT DOCUMENTS

| | | | |
|---|---|---|---|
| 3,231,202 | 1/1966 | Milligan | 431/328 |
| 4,397,631 | 8/1983 | Fisher . | |
| 5,104,309 | 4/1992 | Krieger | 431/328 |
| 5,409,375 | 4/1995 | Butcher | 431/328 |
| 5,547,372 | 8/1996 | Smith . | |

FOREIGN PATENT DOCUMENTS

| | | | |
|---|---|---|---|
| 558007 | 6/1957 | Belgium | 431/328 |
| 0 195 360 | 9/1986 | European Pat. Off. . | |
| 0 451 923 | 10/1991 | European Pat. Off. . | |
| 237321 | 11/1969 | Russian Federation | 431/328 |
| 2 241 567 | 9/1991 | United Kingdom . | |
| 2 266 585 | 11/1993 | United Kingdom . | |

*Primary Examiner*—Carroll B. Dority
*Attorney, Agent, or Firm*—Oblon, Spivak, McClelland, Maier & Neustadt, P.C.

[57] ABSTRACT

A flame support 20 has a plurality of discrete regions 22 through which fuel/air mixture can pass by means of burner ports 13 which extend through the support to a multiplicity of openings 25 at the flame supporting side 24. The support 20 comprises barriers 21/26 which extend between and separate the discrete regions 22. The barriers serve to prevent the passage of fuel/air mixture from upstream of the support to the downstream side 24 of the support in a region between the discrete regions. In burners provided with such a flame support, the likelihood of resonant combustion noise occurring has been found to be reduced.

60 Claims, 17 Drawing Sheets

Figure 1:
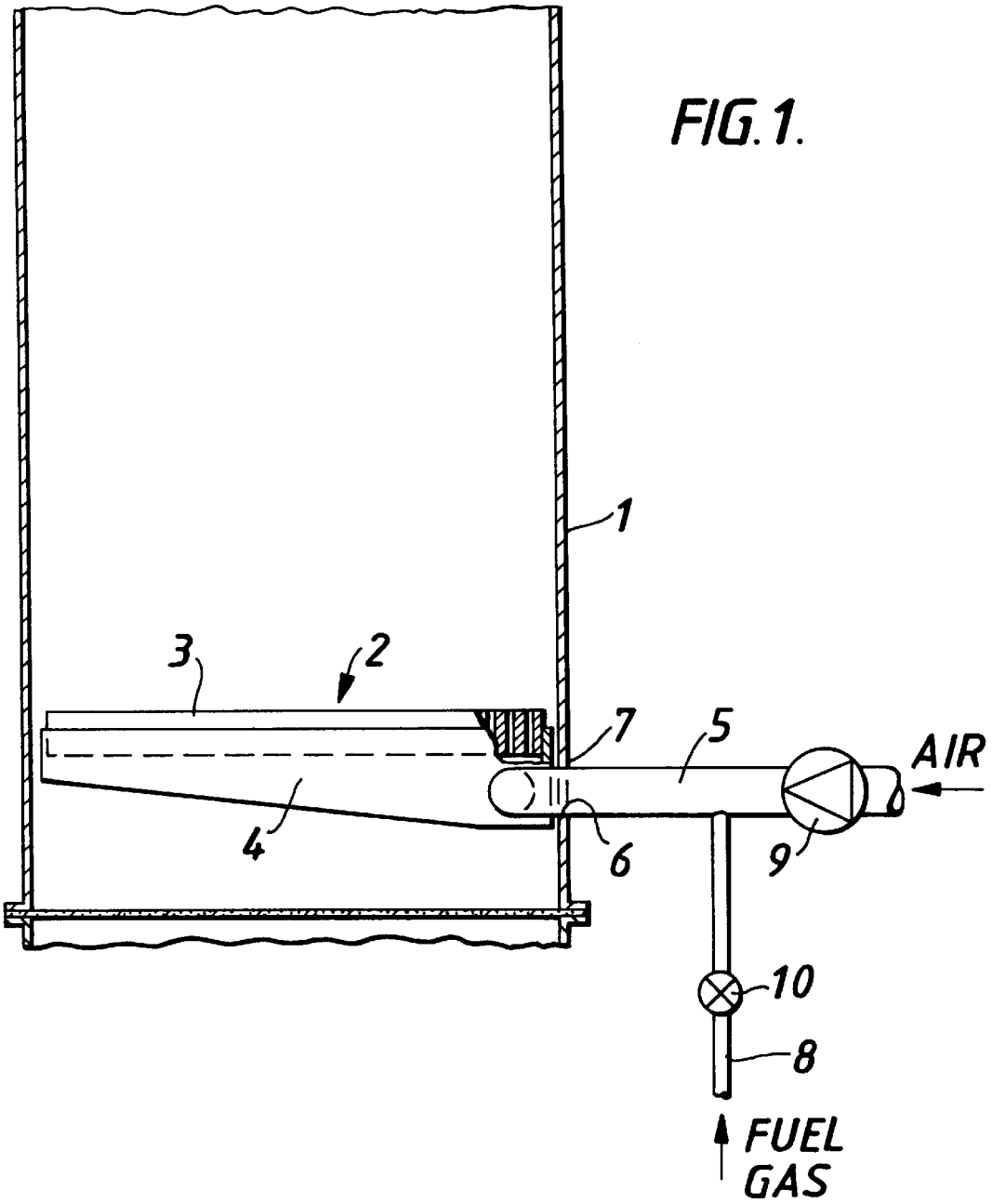

1
2
3
4
5
6
7
8
9
10
AIR
FUEL
GAS

FUEL FIRED BURNERS

The present invention relates to a fuel-fired burner, and particularly a gas-fired burner, which preferably is of the fully premixed type, i.e. one in which the fuel gas is mixed with all the combustion air in a mixing chamber before the gas is combusted.

One kind of fully premixed burner comprises a plenum chamber into which an externally prepared mixture of air and fuel gas, such as natural gas, is introduced before being discharged more or less uniformly through slots or ports in a flame support, block, plaque, plate or strip which may or may not form a part or wall of the chamber. The mixture is combusted at a point within or downstream of the support, block, plaque, plate or strip, to produce combustion products. The combustion products may then enter a first enclosure leading to a second enclosure such as a heat exchanger when the burner is used as a heat source in a heating appliance, such as a boiler. A fully premixed burner is described, by way of illustration, in our published UK Patent Application No. 2176588A.

Although burners of this kind can operate satisfactorily at relatively low heat input/output levels there is a tendency for these burners under certain conditions to generate unacceptable intensities of so-called combustion driven resonant noise, particularly when the burner is operated in a blue flame mode at relatively high heat outputs per unit of burner surface area (i.e. at relatively high gross burner port loadings).

An object of the invention is to provide a burner which has a relatively high satisfactory turndown ratio and in respect of which the likelihood of resonant combustion noise is alleviated or reduced.

According to one aspect of the invention there is provided a fuel fired burner comprising a chamber for receiving a premixture of fuel and air, and a generally flat flame support extending across the chamber, the flame support having a plurality of discrete regions through which fuel/air mixture can pass from the upstream side of the flame support by means of passages which extend through the flame support to a multiplicity of flame support openings at the downstream side of the flame support, the flame support comprising barrier means which extend longitudinally between the discrete regions and distance the regions from each other and which are for preventing the passage of fuel/air mixture from upstream of the support to the downstream side of the support in a region between the discrete regions.

Preferably the burner is constructed and arranged such that when the burner is operating correctly within a given heat output range for the burner, at the minimum output level and relatively low output levels of the range the burner operates in a radiant mode with burner flames substantially stabilised at relatively small area bases defined by the flame support openings, without retracting through the openings into the flame support and causing lightback. At the maximum output level and relatively high output levels of the range the burner operates in a blue flame mode, the burner flames which were stabilised at or associated with the flame support openings having coalesced or merged to provide in respect of each discrete region a single larger flame substantially stabilised at or supported from the larger area base defined by the peripheral edge around the associated discrete region.

The terms 'downstream' and 'upstream' should be understood by having regard to the intended direction of flow of the premixture through the flame support.

The discrete regions of the flame support may comprise substantially equally distributed equi-sized burner ports which extend through the regions from the upstream side of the support to the downstream side whereat the ports terminate in the flame support openings. The burner ports may be of annular cross section, for example substantially circular in which case the burner ports may be of substantially straight cylindrical form.

In one embodiment substantially the whole of the downstream side of the flame support lies in substantially a common plane.

Preferably, channel means are provided in the surface of the downstream side of the flame support and extend between the discrete regions, with the barrier means preventing the passage of fuel/air mixture from upstream of the support issuing into the central portion of the associated channel means for substantially the whole length of the channel means.

To each side of the or each barrier means the flame support may allow fuel/air mixture to pass from the upstream side by means of further passages through the flame support to further flame support openings which open into the channel means at or closely adjacent the respective side wall of the channel means and which are arranged so that when the burner is in use flames originating from the further support openings are directed along a portion of the respective side wall in the direction of the mouth of the channel means. The side walls of the channel means are thereby heated and the presence of the resulting hot side walls enhances the retention and stabilisation of the flames associated with the adjacent discrete regions.

The further passages may comprise burner ports.

Preferably, the opposite sides of the mouth of the channel means are bevelled, as opposed to being relatively sharp edged, as this reduces the likelihood of detrimental effects occurring to the flame support material as a result of localised overheated spots in the region where a side wall of the channel means meets the downstream side of an adjacent discrete region.

The channel means may comprise a plurality of spaced channels extending substantially in parallel.

The flame support may comprise a plurality of further spaced channels in the downstream side of the flame support, with each of the further channels extending through one or more of the discrete regions transversely to the previously mentioned channels. In this case, the further channels are included or contained within the discrete regions themselves, apart from the areas where the channels and further channels intersect. Investigations by the applicants have indicated that the provision of the further channels serve to break up the continuity of the surfaces of the discrete regions and provides a greater resistance to the occurance of combustion driven resonance.

The opposite sides of the mouth of each further channel may be bevelled for the same reasons that the previously mentioned channels are bevelled.

Conveniently, the channels and/or further channels are straight or rectilinear.

Preferably, an outermost channel means is provided in the surface of the downstream side of the flame support and extends around the flame support so as to lie between outer edges of discrete regions and the peripheral edge of the support, with the flame support also comprising a barrier means extending longitudinally of the outermost channel means for preventing passage of fuel/air mixture from upstream of the support issuing into the central portion of the outermost channel means. To each side of the barrier means the flame support allows fuel/air mixture to pass from the upstream side by means of respective passages which extend through the flame support to flame support openings which open into the outermost channel means. The arrangement is such that, when the burner is in use, flames originating or emerging from these support openings are directed along portions of the respective side walls of the outermost channel means in the direction of the mouth of the channel means, with the inner one of the side wall portions terminating in the outer edges of the discrete regions and the outer one of the side wall portions terminating in the peripheral edge of the flame support. The peripheral edge of the support and the outer edges of the discrete regions thereby become heated, reducing the heat losses which would otherwise occur in the absence of this arrangement and as a consequence enhancing desired resistance to flame lift at these edges.

The passages which open into the outermost channel means may comprise burner ports, for example of annular cross-section.

The opposite sides of the mouth of the outermost channel means may be bevelled for the same reasons that previously mentioned channels may be bevelled.

In an alternative form, at least portions of the discrete regions forming the flame support openings associated with those discrete region portions are comprised of porous material having pores serving as the passages, or portions of the passages, through which the fuel/air mixture can pass to such associated flame support openings.

In such a case, conveniently the flame support comprises an upstream part comprising the barrier means, and over at least a portion of one or more of the discrete regions the flame support also comprises an associated downstream part, or respective associated downstream parts, of porous material, the passages comprising first passage portions constituted by burner ports or through holes extending through the upstream part and second passage portions which comprise pores extending through the porous downstream part or parts, with these pores communicating with associated first passage portions and leading to the flame support openings at the downstream side of the downstream part or respective downstream part.

The burner ports or through holes may be substantially equisized and substantially equally distributed over the upstream part or parts of the discrete regions, and may be circular in cross-section.

The discrete regions may comprise a plurality of downstream parts having side walls, with opposing side walls of adjacent spaced apart downstream parts together with the barrier means defining a channel between adjacent discrete portions. The barrier means is arranged to prevent the passage of fuel/air mixture from upstream of the upstream support part issuing into the central portion of the associated channel for substantially the whole length of the channel.

To each side of the or each barrier means the upstream part may allow fuel/air mixture to pass from the upstream side by means of further passages through the upstream part to further flame openings in the upstream part which open in the channel at or closely adjacent the side wall of the respective adjacent downstream part and which are arranged so that, when the burner is in use, flames originating from the further flame openings are directed along a portion of each respective side wall in the direction of the mouth of the channel.

The further passages in the upstream part may comprise burner ports or through holes.

Preferably, the opposing side walls of the adjacent porous downstream parts are bevelled at the mouth of the channels.

In one arrangement the flame support comprises a plurality of barrier means and spaced apart downstream parts which together define a plurality of spaced channels extending substantially in parallel.

In one embodiment other opposing side walls of the plurality of downstream parts define therebetween together with the upstream part a plurality of further spaced channels which extend through or across the discrete regions transversely to the previously mentioned channels.

Preferably, the opposing side walls of the downstream parts defining the further channels are bevelled at the mouth of these channels.

Advantageously, the flame support has a peripheral wall which extends around the edge thereof and which together with outer side walls of downstream parts and the upstream part defines an outermost channel means which extends around the flame support, with the upstream part comprising a barrier means extending longitudinally of the outermost channel means for preventing passage of fuel/air mixture from upstream of the upstream part issuing into the central portion of the outermost channel means, and to each side of the barrier means the upstream part allows fuel/air mixture to pass from the upstream side of the upstream part by means of respective passages which extend through the upstream part to flame support openings which open into the outermost channel means and are arranged such that, when the burner is in use, flames originating or emerging from these support openings are directed along portions of the said outer side walls of the downstream parts and the peripheral wall in the direction of the mouth of this channel means.

Preferably, the peripheral wall and the outer side walls of the downstream parts defining the outermost channel are bevelled at the mouth thereof.

According to another aspect of the invention, there is provided a generally flat flame support for use in a fuel fired burner, the flame support having a plurality of discrete regions through which fuel/air mixture can pass from its intended upstream side by means of passages which extend through the flame support to a multiplicity of flame support openings at the intended downstream side of the flame support, the flame support also having barrier means which extend longitudinally between the discrete regions and distance or space the regions from each other and which are for preventing the passage of fuel/air mixture from upstream of the support to the downstream side of the support in a region between the discrete regions.

Figure 2B:
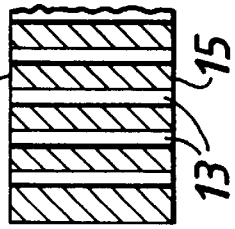
Figure 2A:
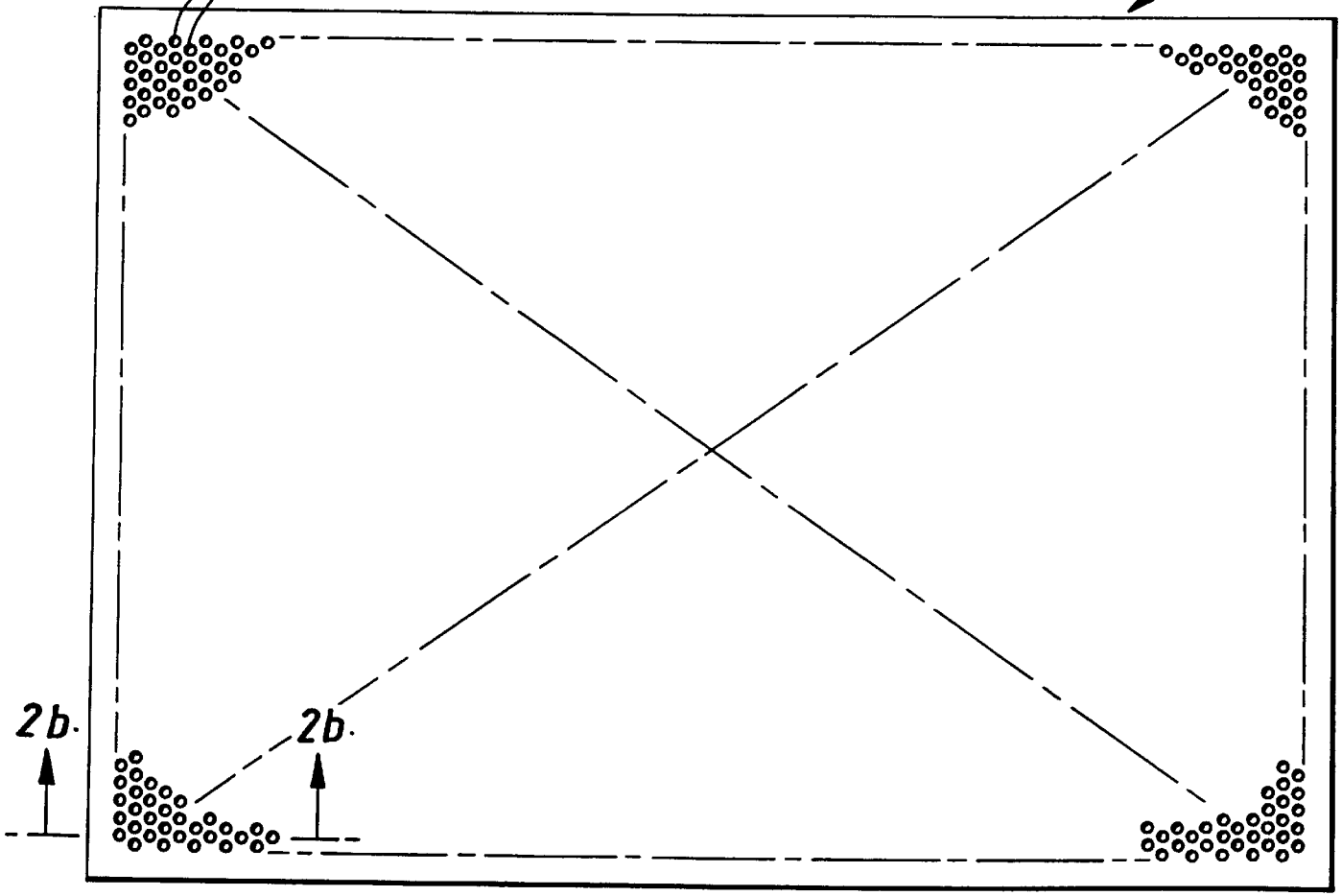
Figure 4A:
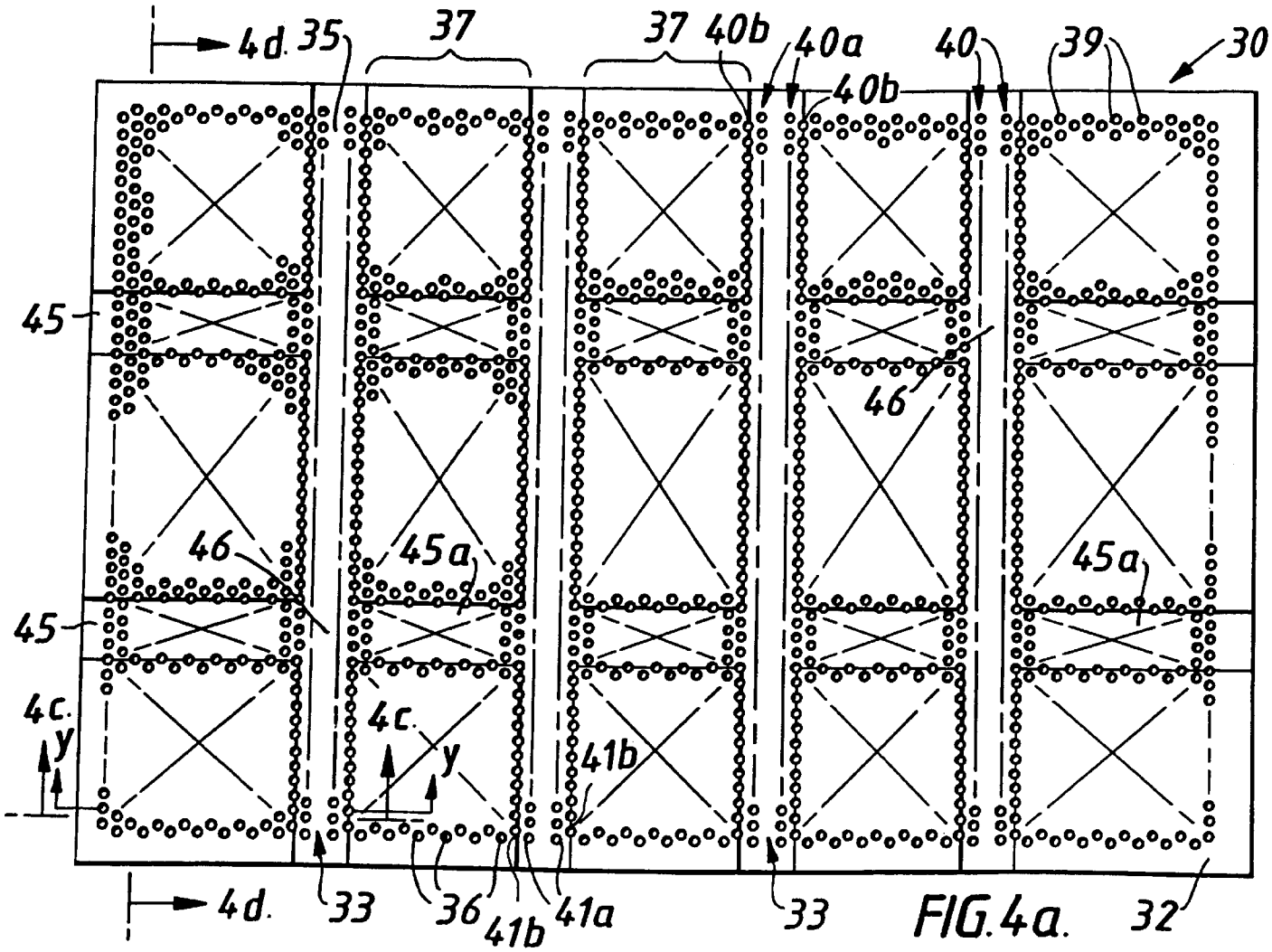
Figure 4B:
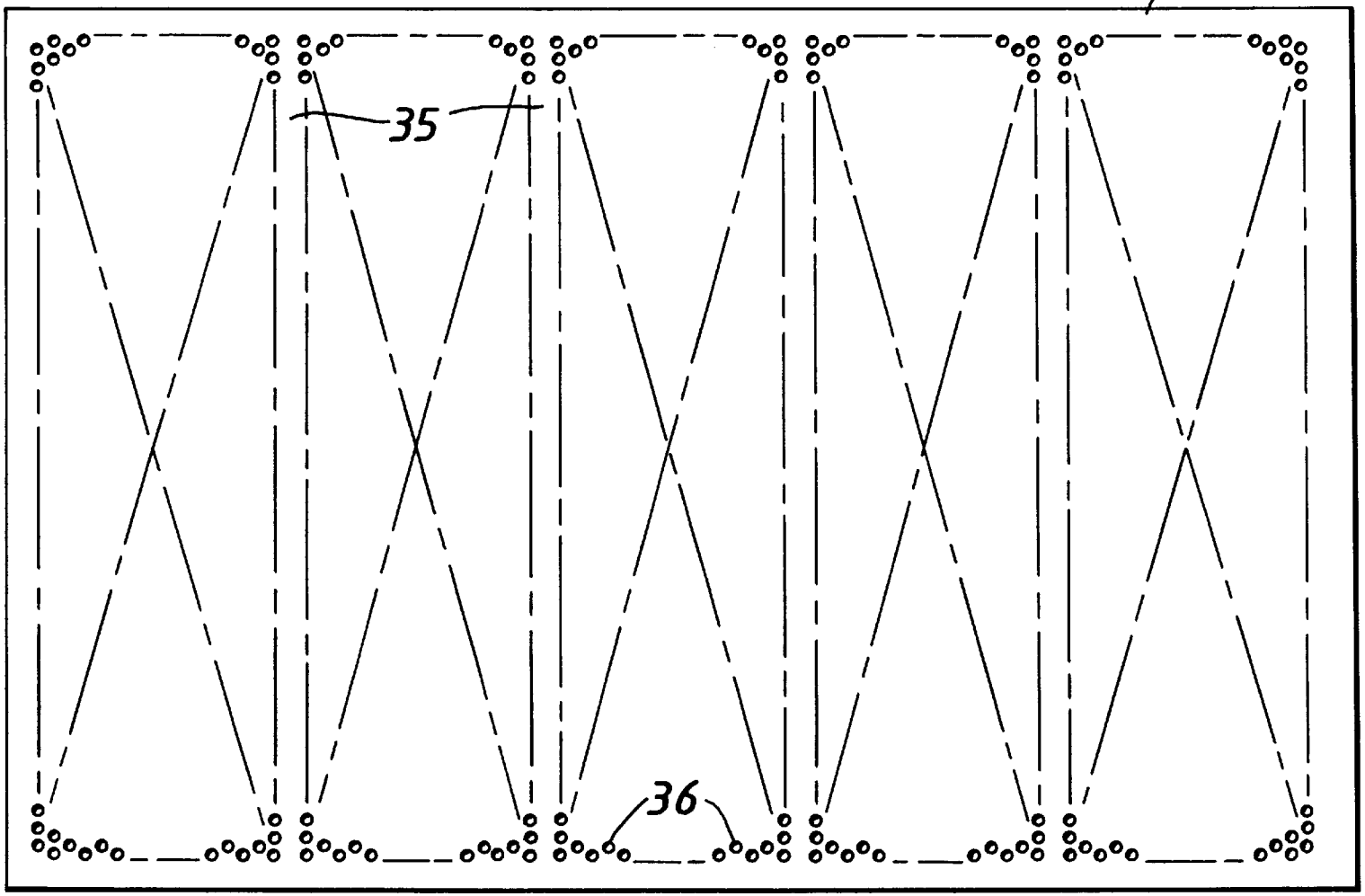
Figure 4C:
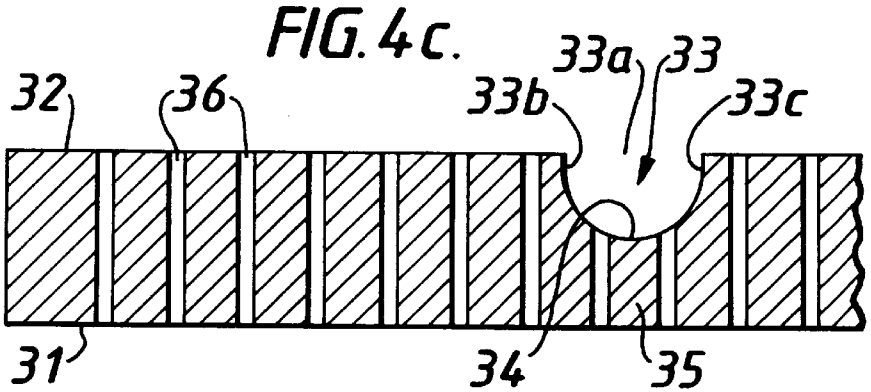
Figure 4D:
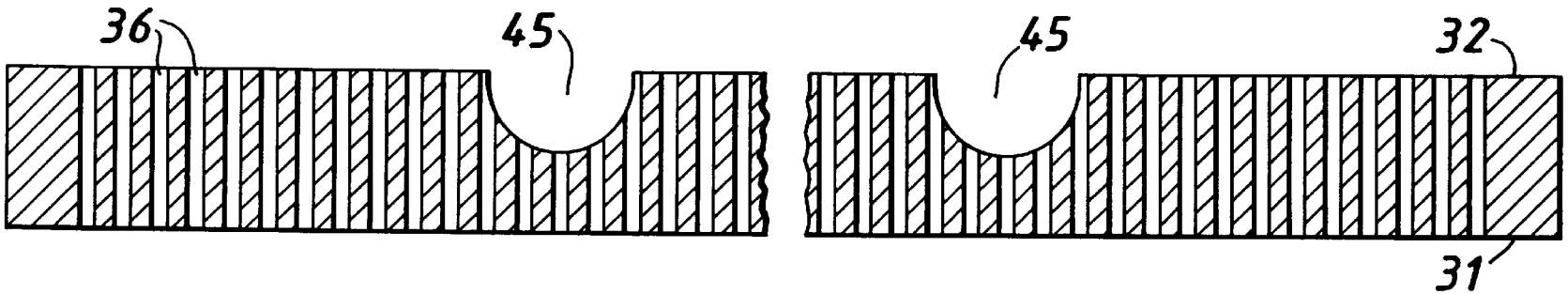
Figure 4E:
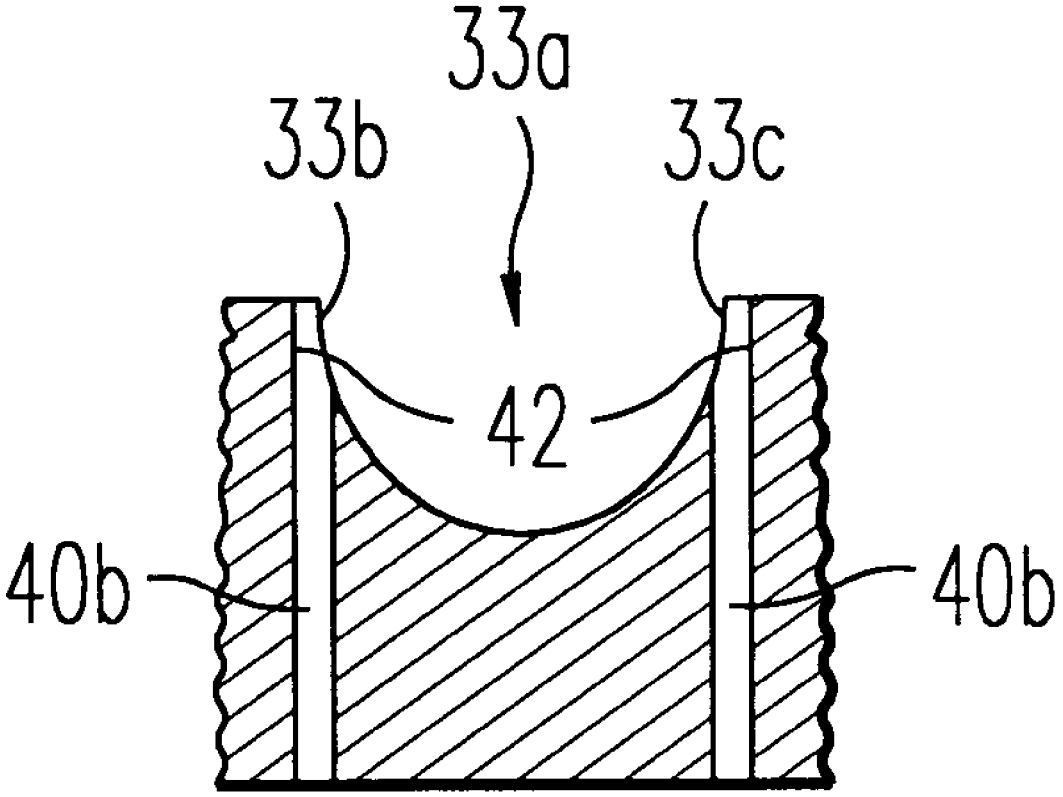
Figure 5A:
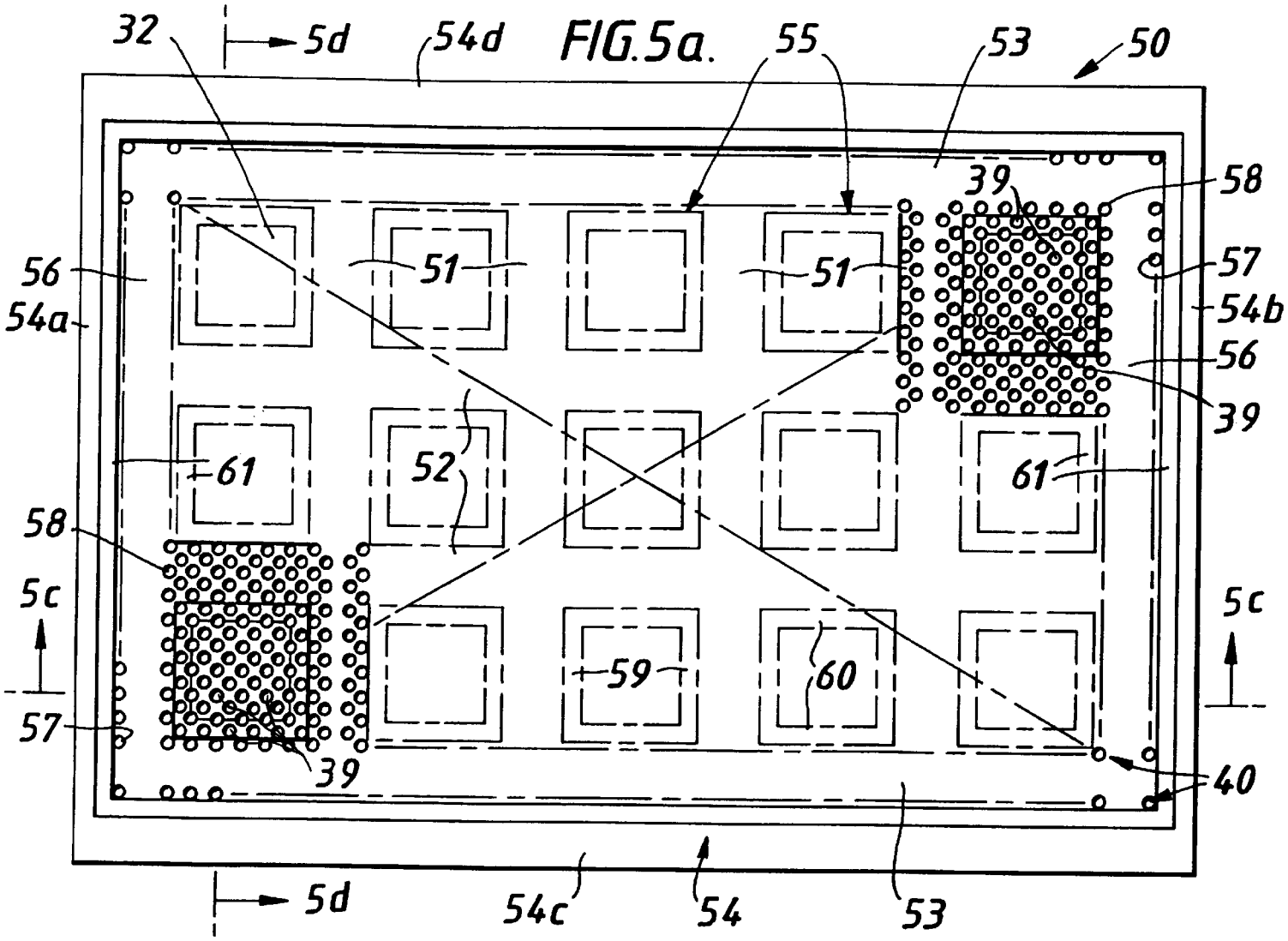
Figure 5B:
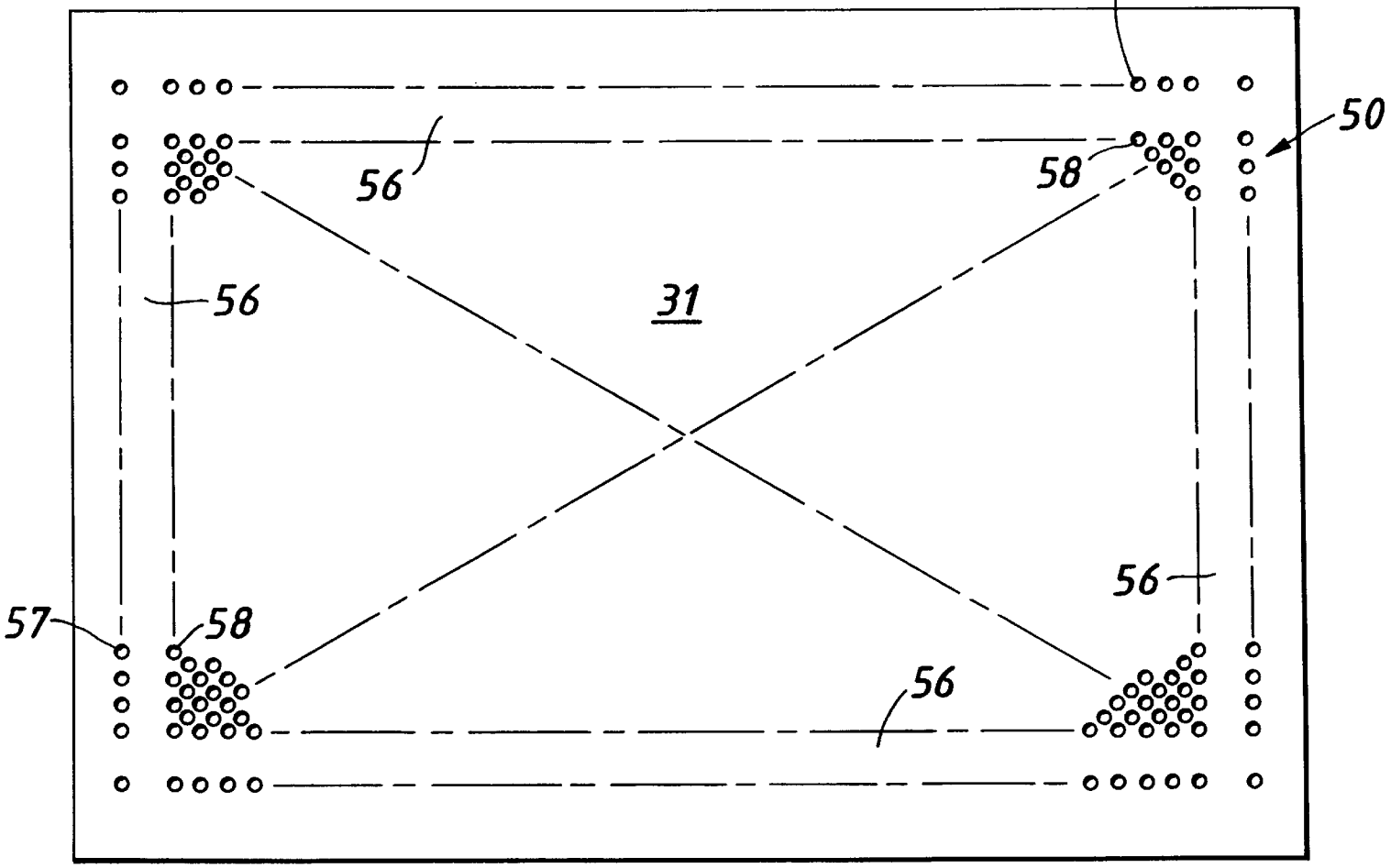
Figure 5C:
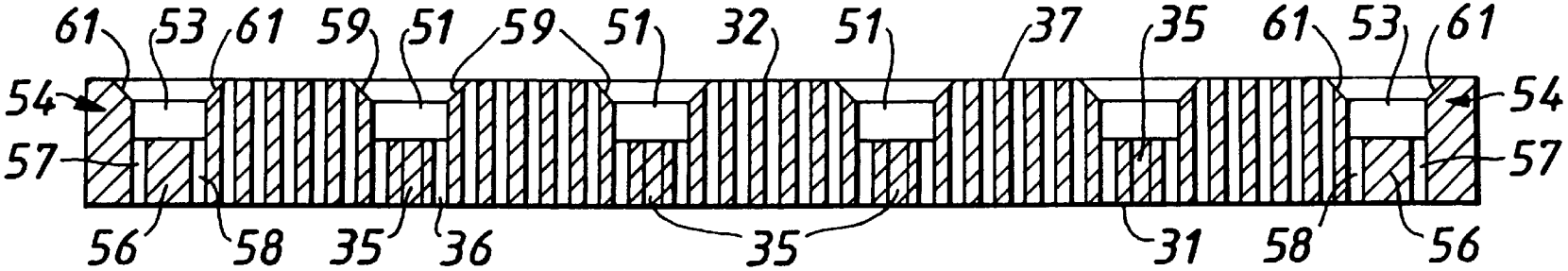
Figure 5D:
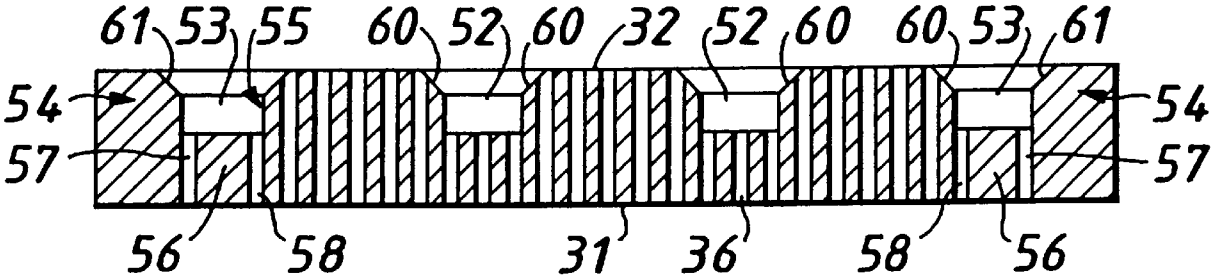
Figure 6A:
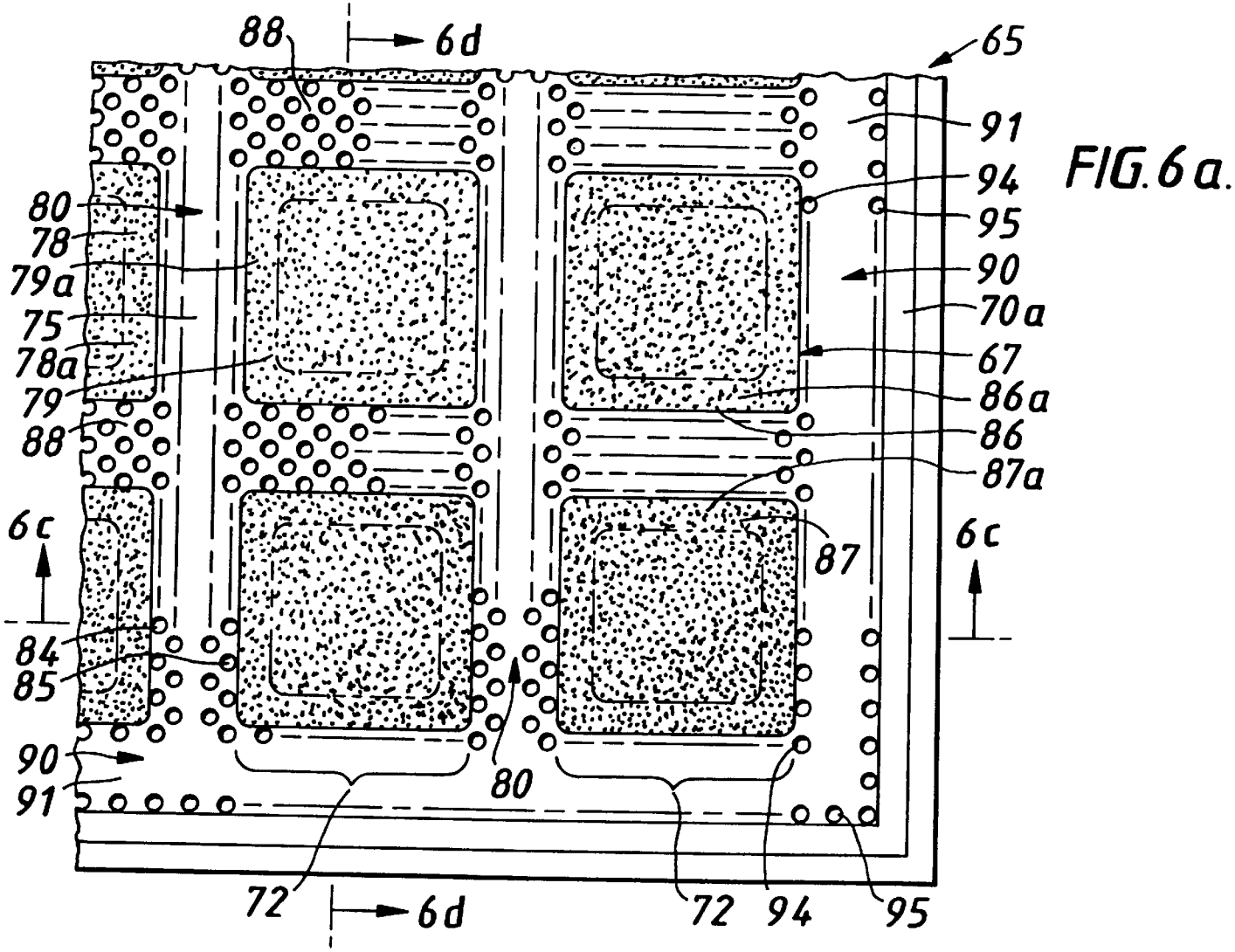
Figure 6B:
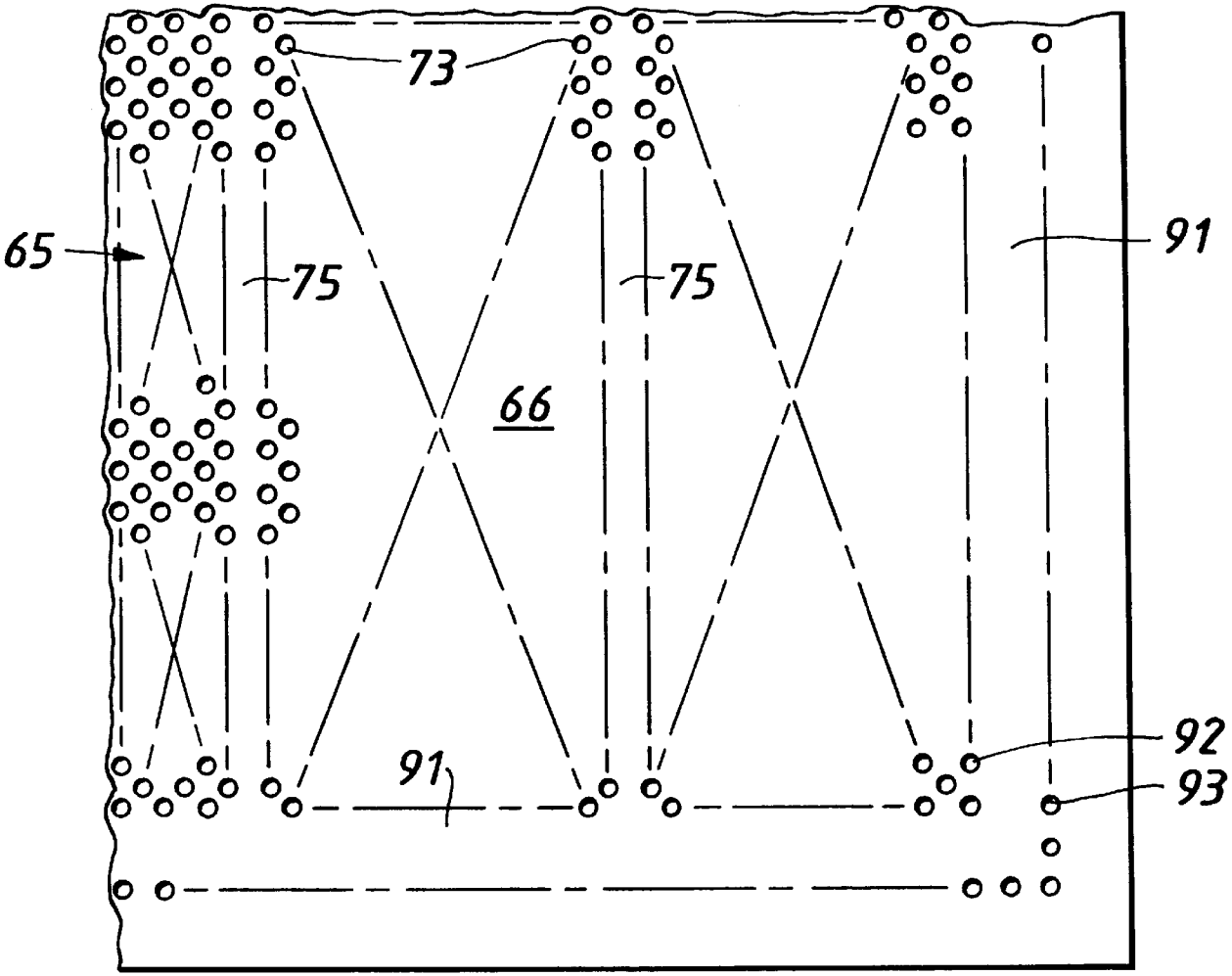
Figure 6C:
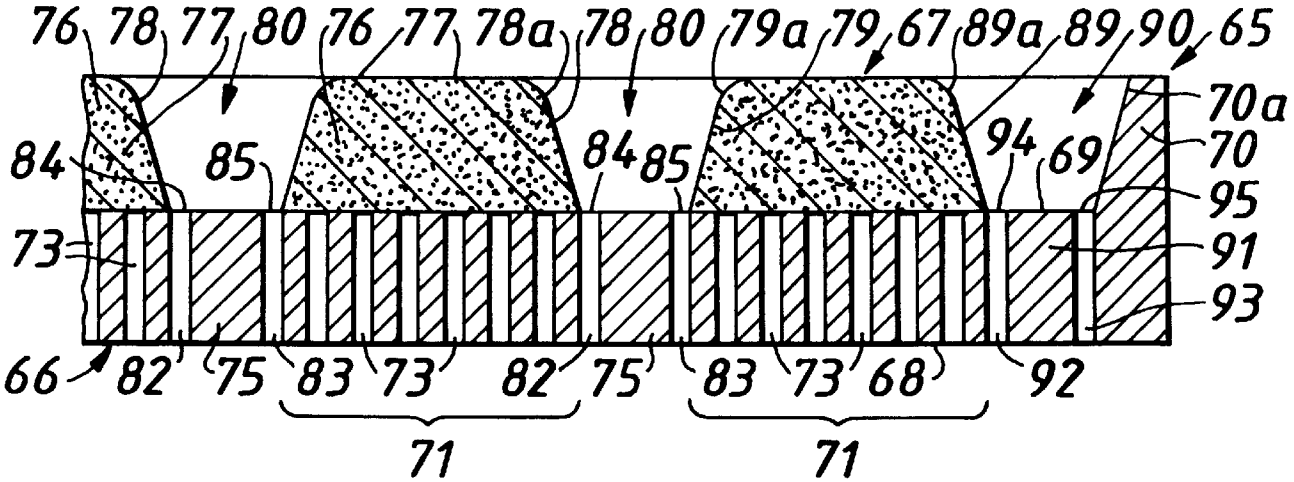
Figure 6D:
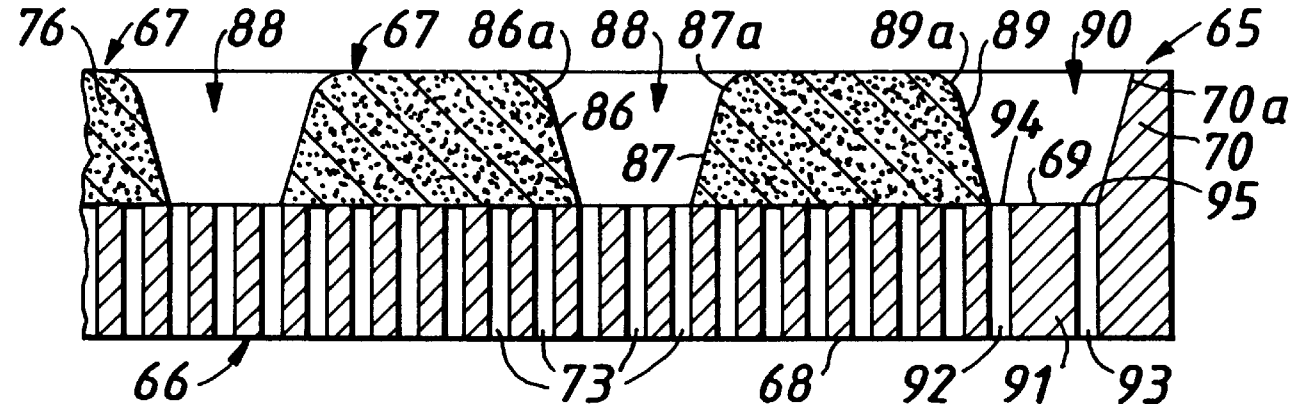
Figure 7:
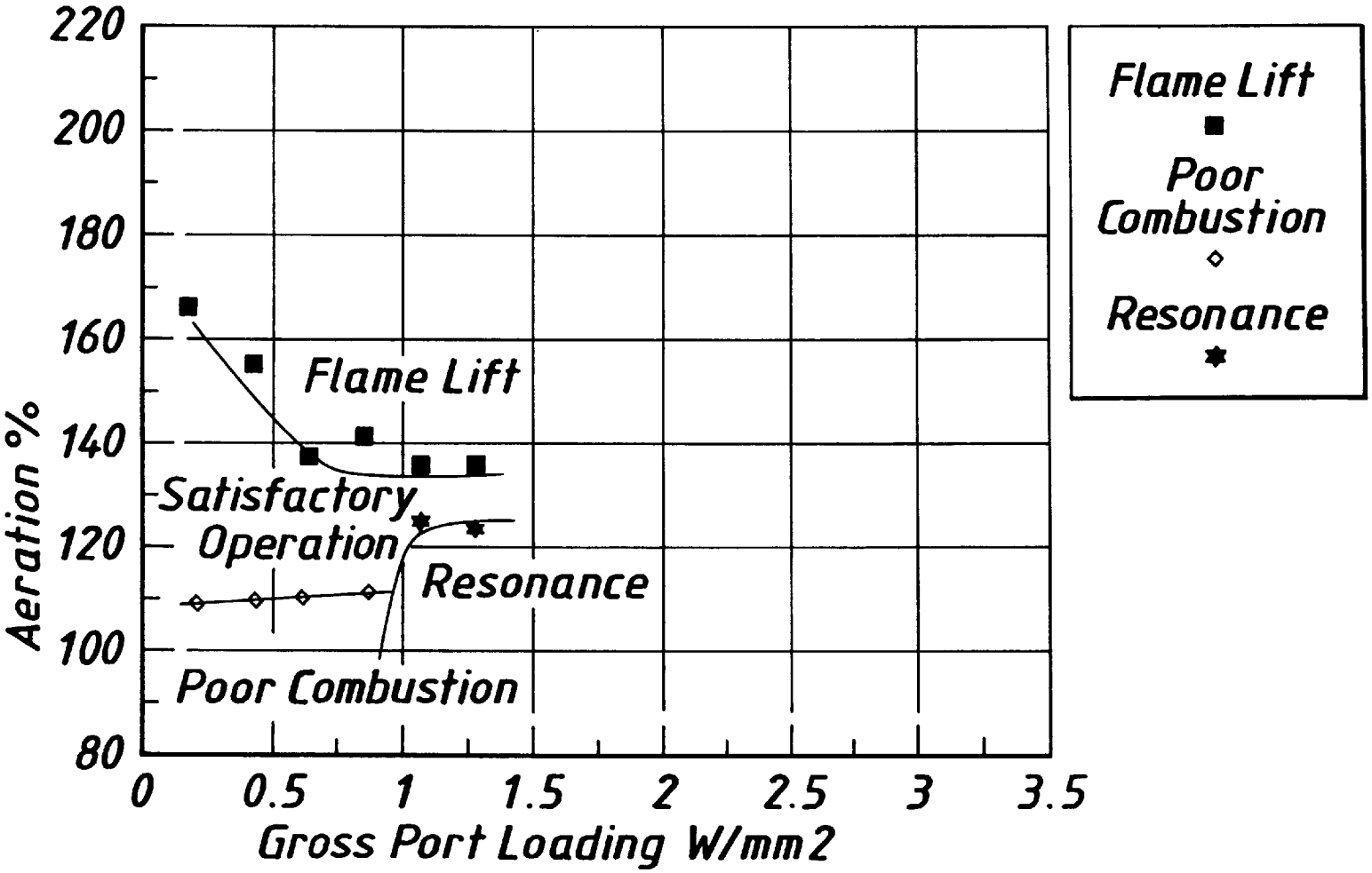
Figure 8:
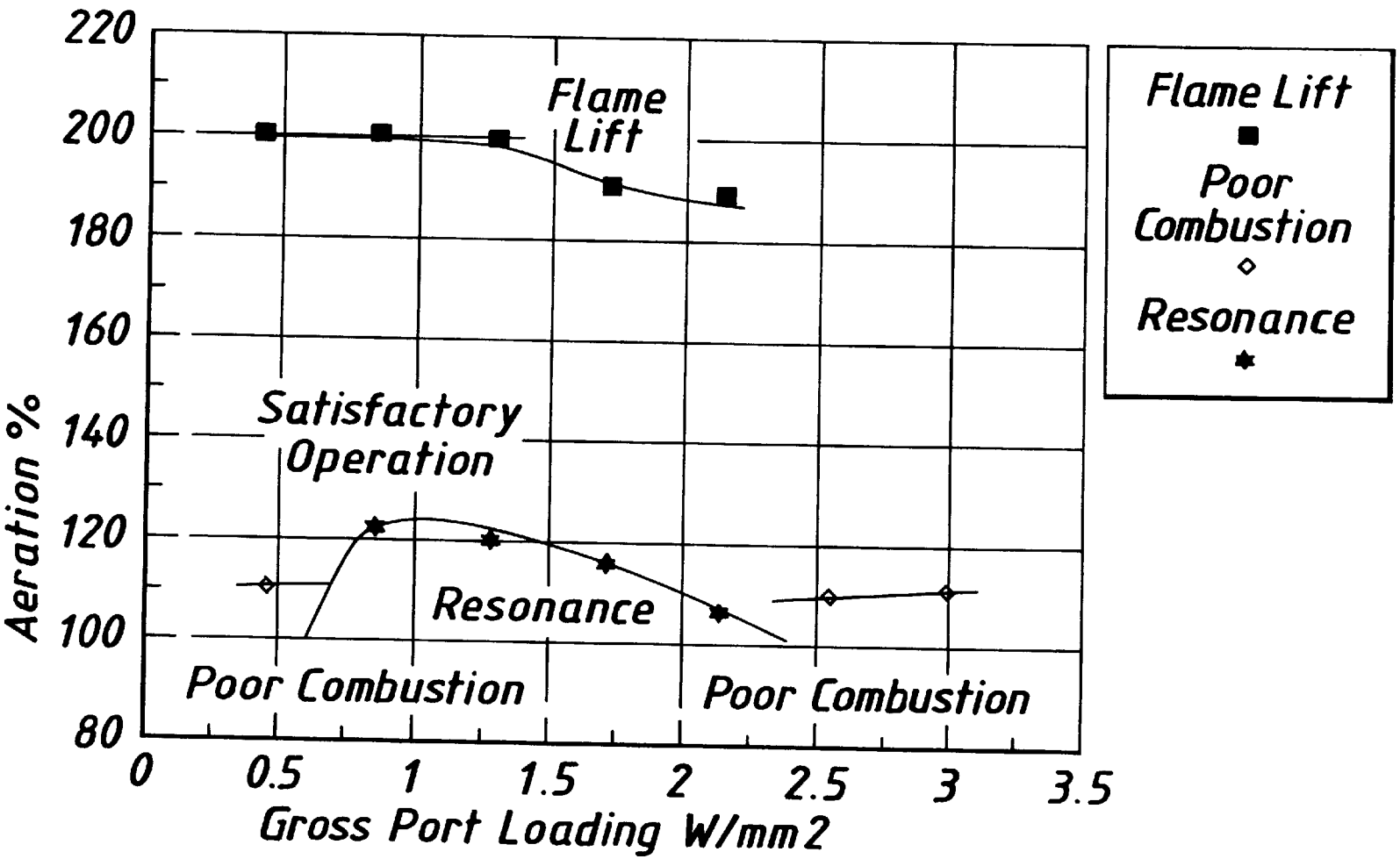
Figure 9:
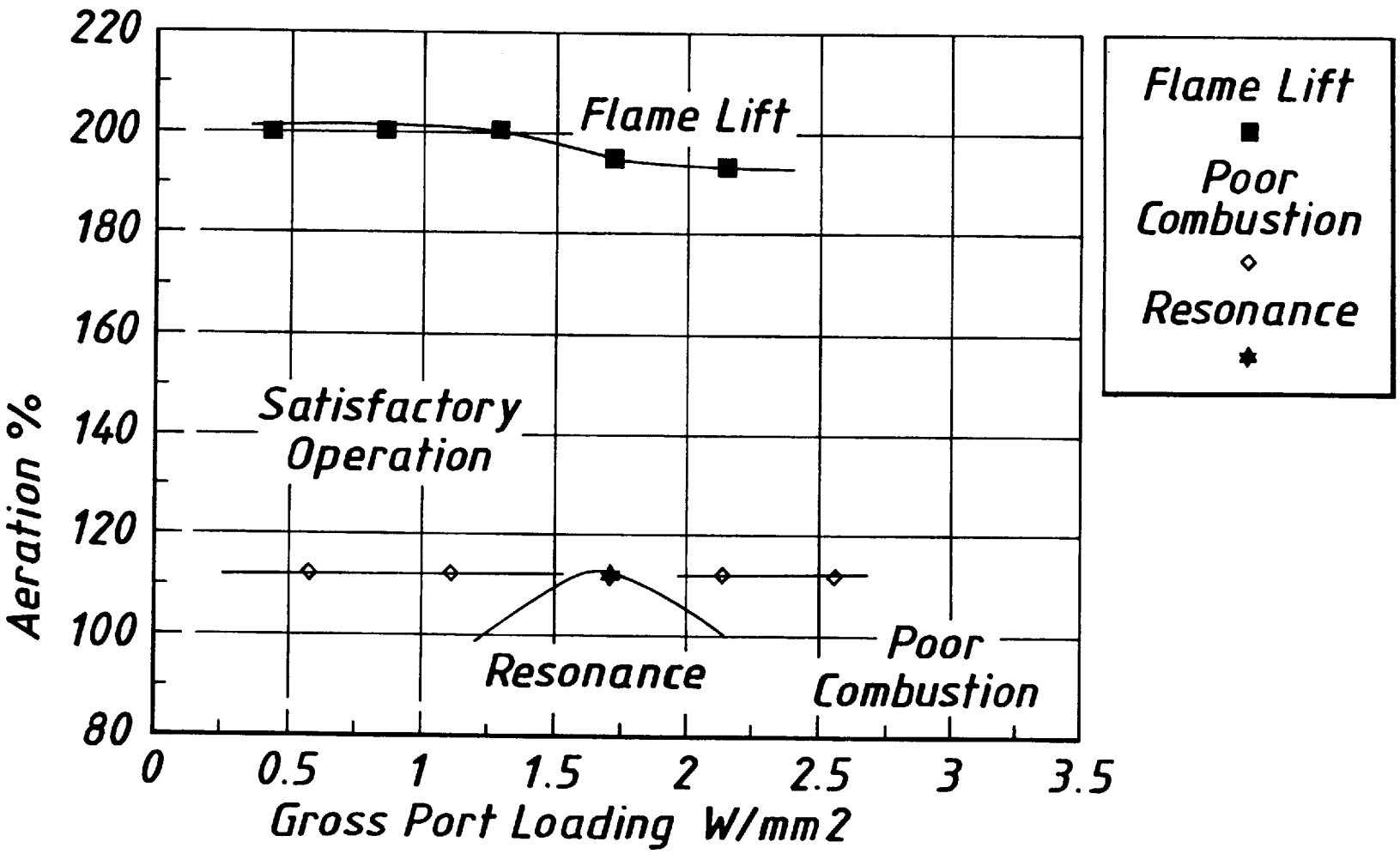

In order that the invention may be more readily understood, reference will now be made, by way of example only, to the accompanying drawings, in which:

FIG. 1 is a schematic partly sectioned side view of a combustion system comprising a form of burner and associated flame support according to the present invention, FIGS. 2*a* and 2*b* show, respectively, a plan view from above, and an enlarged cross-sectional view on the line A—A of a flame support construction which the Applicants modified to produce the embodiments shown in FIGS. 3, 4, 5 and 6, FIGS. 3*a*, 3*b* and 3*c* show, respectively, a plan view from above, and enlarged cross-sectional views on the lines C—C and D—D of one embodiment of flame support according to the invention for use in the burner, FIGS. 4*a*, 4*b*, 4*c*, 4*d* and 4*e* show, respectively, a plan view from above, a plan from below, and enlarged cross-sectional views on the lines E—E, F—F and yy of another embodiment of flame support, FIGS. 5*a*, 5*b*, 5*c* and 5*d* show, respectively, a plan view from above, a plan from below, and illustrative cross-sectional views on the lines G—G and H—H of a further embodiment of flame support, FIGS. 6*a,* 6*b,* 6*c* and 6*d* show respectively, a plan view from above, a plan view from below, and cross-sectional views on the lines I—I and J—J of part of an alternative embodiment of flame support, and FIGS. 7, 8 and 9 show burner combustion graphs of aeration versus gross port loading based on results obtained by Applicants comparative experiments on burners comprising the flame supports described in relation to FIGS. 2*a,* 2*b,* 3*a–c* and 4*a–d* respectively.

Referring to FIG. 1, the combustion system comprises an elongate rectangular section steel chamber 1 serving as a flue duct and within which is mounted a fully premixed burner 2.

The fully premixed burner 2 is mounted in the duct with the flame support 3 extending horizontally.

The flame support 3 which is of generally flat form surmounts and extends across a plenum chamber 4 to which is connected a main air supply pipe 5 which extends outwardly through a port 6 in a wall 7 of the flue duct 1. This pipe is connected to a fan (not shown).

A branch pipe 8 which is connected to the air supply pipe 5 is fed with fuel gas from a fuel supply source (not shown). The pipes 5 and 8 are provided with valves 9 and 10, respectively, upstream of the branch connection for independently regulating the flow rates of air and gas.

The flame supports or plaques according to the invention and used in Applicants experiments were made from a high temperature ceramic material, such as a mullite-silica ceramic material.

The flat rectangular support 12 as shown in FIG. 2*a* measured approximately 130 mm by 90 mm by 12 mm and was perforated with 3619 ports 13 of circular cross section of 1.1 mm diameter. The underside of the support 12 corresponds to the upper side of the support.

The arrangement of the 47 rows and 77 columns of holes were such as to provide the surface of the support with an open area of approximately 33%.

Both sides 14, 15 of the support are flat and none of the ports are obstructed. This plain form was known to give good results in a burner operating as a low input radiant plaque burner but combustion driven resonant noise occurs at relatively low port loading.

Figure 3A:
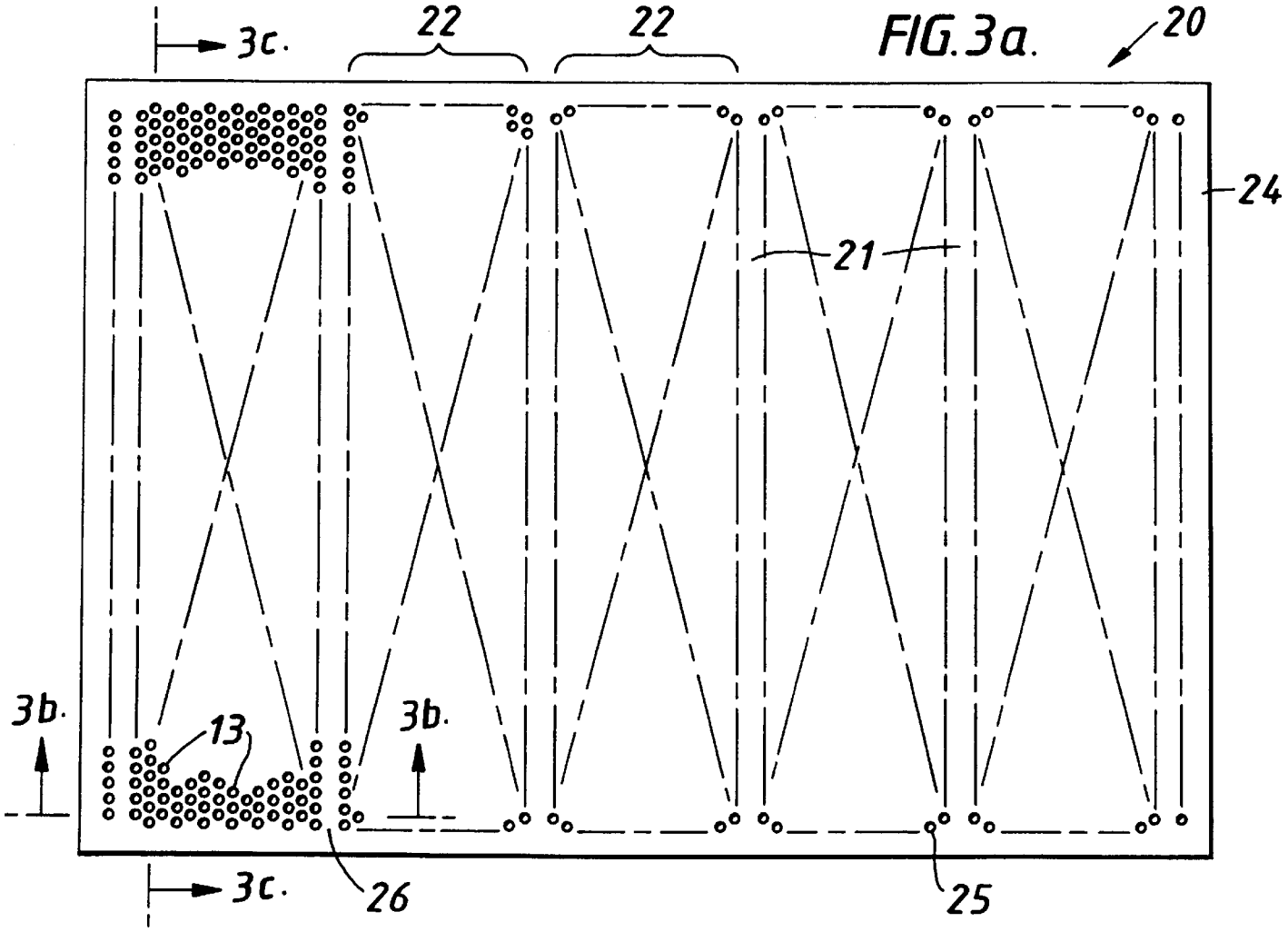
Figure 3B:
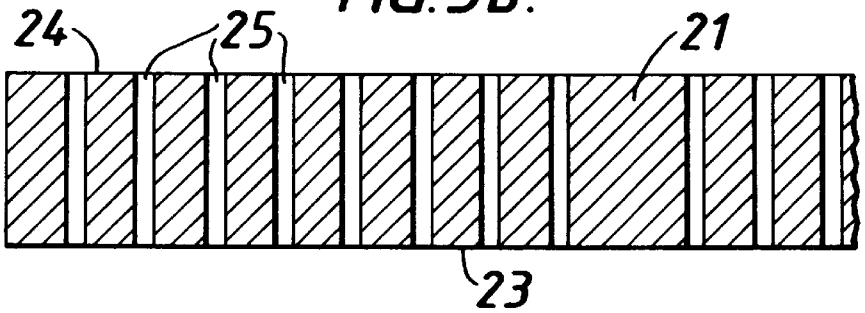
Figure 3C:
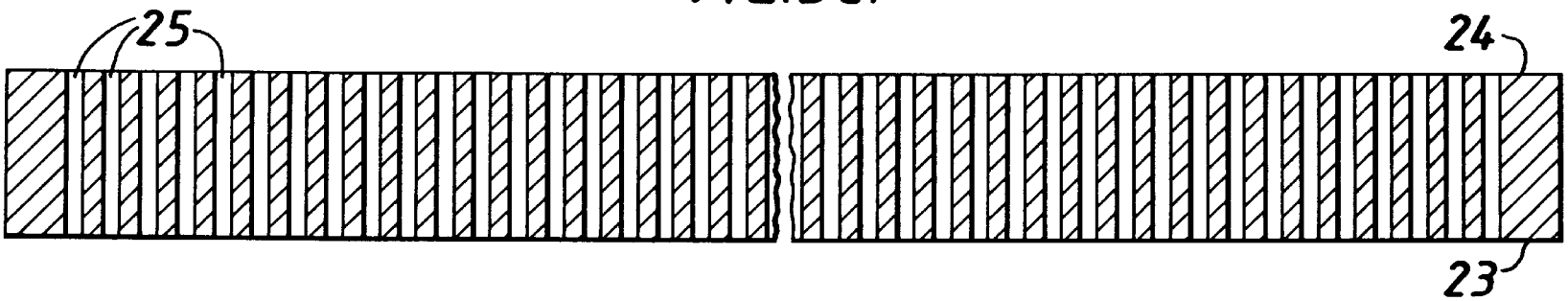

In the embodiment of flame support 20 shown in FIG. 3*a* every 15th column of ports that was present in flame support 12 in FIG. 2*a* (starting with the second column of ports in from each end of the support 12) has been omitted, leaving a line 21 of solid support material in place of those ports. Thus, the FIG. 3*a* flame support has discrete regions 22 comprising 14 columns of substantially equally distributed equi-sized burner ports 13 of straight cylindrical form which extend through the support from the upstream side 23 to the downstream side 24 whereat the ports 13 terminate in flame support openings 25. The lines 21 of support material form barrier means 26, which in effect extend longitudinally between the discrete regions 22 and distance or space the regions from each other, and also provide 'lines of land' for adjacent flames between the discrete regions to enhance flame retention at the downstream sides 24 of the discrete regions at higher heat output loadings of the burner. The barrier means 26 prevent the passage of fuel/air mixture from upstream of the support to the downstream side 24 in the portions or regions between the discrete regions 22. The width of each discrete region, i.e. the distance between adjacent lines 21 was approximately 23.1 mm.

The upstream side or underside 31 of the embodiment of flame support 30 shown in FIG. 4*a* is the same as shown in the FIG. 3*a* embodiment. The downstream side or upper side 32 of the support is provided with a plurality of spaced parallel straight channels 33, each of which extends across the support. The longitudinal central portion 34 of each channel is aligned with or directly above a line 35 of solid support material, forming a barrier means, (where a column of ports 36 have been omitted). The barrier means 35 extend between adjacent discrete regions 37 and also provide 'lines of land' between the discrete regions. Ports 36 extend through the discrete regions from the upstream side 31 to the downstream side 32 whereat the ports terminate in flame support openings 39. Each channel 33 is generally U-shaped with a maximum depth of approximately 6 mm and a width at its mouth 33*a* of approximately 7 mm. The dimensions and arrangement of each channel is such that the associated barrier means 35 prevents the passage of fuel/air mixture from upstream of the support issuing into the central portion of the channel. It will be appreciated from FIGS. 4*a,* 4*c* and 4*e* that the two lines of ports 40*a* (inner ones) and 40*b* (outer ones) immediately to each side of the line of land 35 extend from the upstream side 31 of the support to open at flame support openings 41*a* and 41*b* in the channel at and adjacent to the respective side wall 33*b,* 33*c* of the associated channel 33. The side walls of the channels, which are common with the sides of the discrete regions, include grooves 42 which are in effect extensions of sides of the ports of the outer lines of ports 40*b* and which extend to the downstream side 32 of the flame support. When the flame support 30 is used in the burner, flames originating from the support openings 41*b* are directed generally along the grooves 42 in the side walls in the direction of the mouth 33*a* of the channels. FIG. 4*e* shows a cross section along line yy of FIG. 4*a* which shows the relationship between the outer line of ports 40*b* and the sidewalls 33*b* and 33*b.* The side walls 33*b,* 33*c* can thus be heated and the resulting hot side walls further enhance flame retention and stabilisation at the discrete regions at higher heat output loadings of the burner.

The downstream side 32 of the FIG. 4*a* embodiment of the flame support is also provided with two spaced parallel straight U-shaped channels 45 which extend from one end of the support to the other perpendicularly to the channels 33 and extend through the discrete regions 37. Thus portions 45*a* of the channels form parts of the discrete regions 37. The channels 45 are located symmetrically on the support. They are 6 mm deep and 7 mm wide at the mouth like the channels 33. The ports in the rows of ports embraced by the channels 45 open into the respective channels 45. The channels 45 intersect the channels 33 at regions 46.

The channels 45 serve to break up the continuity of the discrete regions 37 at the downstream side 32 and thereby prevent the formation of too large a continuous flame on each individual discrete region and this was then found by the Applicants to reduce the likelihood of resonance occurring.

The flame support embodiment 50 shown in FIG. 5*a* is similar to that shown in FIG. 4*a* and common features have been allotted the same reference numbers and not described further. However, the layout is such that the downstream side of the flame support is provided with four channels 51 (equivalent to channels 33), two channels 52 (equivalent to channels 45) and, in addition, an outermost channel 53. The outermost channel 53 extends around the whole of the rectangular flame support 50 between the continuous peripheral edge 54 of the support comprises of edge portions 54*a,* 54*b,* 54*c* and 54*d,* and the outer edges 55 of the discrete regions 37 closest to the peripheral edge portions. The edge portions 54*a,* 54*b,* 54*c* and 54*d,* and the outer edges 55 comprise the side walls of the channel 53. The continuous edge 54 also increases the strength of the flame support at its periphery. The flame support also comprises a barrier means 56 constituted by the solid material of the support and extending longitudinally of and at the base of the channel 53 for preventing passage of fuel/air mixture issuing into the central portion of the channel. To each side of the barrier means 56 the flame support comprises lines of burner ports 57 and 58 for allowing fuel/air mixture from upstream of the support into the channel 53. The arrangement is such that when the burner is in use flames originating or emerging from the burner ports 57 and 58 are directed along the peripheral edge ports 54*a*, 54*b*, 54*c* and 54*d* and the outer edges 55 of the associated discrete regions, respectively. The peripheral edge 54 and the outer edges 55 thus become hot and as a result flame retention and stabilisation in these areas are improved.

The lines of ports 57 and 58 may be of smaller diameter than the remaining ports 39 in the flame support in order to provide appropriately sized lines of flames to engulf or lick over the peripheral edge 54 and the side walls 54 of adjacent discrete regions.

The line of flames emerging from ports 57 also serve to produce a hot rising current which stops or inhibits unwanted relatively cool air rushing into the area within the peripheral edge 54 and thereby reduces the heat losses at the edge.

The barrier means 56 also serves to provide line of land 56 and to separate the lines of ports 57 and 58 immediately to each side of it to prevent the two lines of emerging flames from merging together.

In addition the opposite sides of the mouth of each channel 51, 52 and 53 are bevelled as at 59, 60 and 61, respectively, to provide 45° angle bevel surfaces 2 mm wide to avoid a sharp edge junction between the channel walls and downstream side of the discrete regions 37. Applicants investigations have shown that the provision of the bevel surfaces reduces the likelihood of overheating occurring in these areas when the burner is operated at the lower output end of the heat output operating range of the burner.

The embodiment of flame support 65 in FIG. 6*a* is generally of flat rectangular form and comprises an upstream part 66 made, for example, of the same ceramic material as the flame supports described in the earlier embodiments and a plurality of spaced downstream parts 67 made of porous foam ceramic material. The upstream and downstream sides 68, 69 of the upstream part 66 are substantially planar except for the upstanding peripheral wall 70 which extends around the edge of the support 65 and stands proud of the downstream side 69.

The upstream part 66 comprises portions 71 defining parts of the discrete regions 72 the flame support and having a multiplicity of substantially equally distributed and equisized cylindrical through-holes or burner ports 73 of circular cross-section extending therethrough from the upstream side 68 to the downstream side 69. The upstream part also comprises barrier means 75 formed by generally linear solid portions of the ceramic material of the upstream part which extend longitudinally between adjacent discrete regions 72 and distance the regions from each other. It will be appreciated that each discrete region 72 comprises a portion 71 of the upstream part 66 extending across the flame support and the downstream parts 67 associated with the respective portion 71.

Over portions 71 of the upstream part 66 the porous ceramic downstream parts 67 are secured in spaced apart fashion to the downstream side 69 of the upstream part, for example by being cast onto the upstream part. As viewed in FIG. 6*b* and 6*c* the porous ceramic parts 67 overlie the through holes 73 in the upstream parts, and such through holes constitute first passage portions. The porous downstream parts comprise pores 76, constituting second passage portions, which communicate with associated through holes 73 and lead to flame support openings 77 formed by the mouths of the pores at or adjacent the surface of the porous material of the downstream part. Together, the first and second passage portions 73, 76 form passages through which fuel/air mixture can pass from the upstream side 68 of the flame support to the flame support openings 77.

Opposing side walls 78 and 79 of adjacent downstream parts 67 together with the barrier means 75 therebetween define across the flame support respective parallel channels 80 extending between such downstream parts 67 and thus the adjacent discrete regions. The barrier means 75 prevents the passage of fuel/air mixture issuing into the central portion of the associated channel 80 for substantially the whole length of the channel.

On each side of each barrier means 75 the upstream part 66 comprises therethrough burner ports 82, 83, constituting further passages, via which fuel/air mixture can pass to flame openings 84, 85 in the upstream part. The flame openings 84, 85 open into a respective channel 80 adjacent the side walls 78, 79 of adjacent downstream parts and are arranged such that when the flame support is located in a burner and the burner is in use, flames originating from the flame openings are directed along a portion of each respective side wall in the direction of the mouth of the channel.

The opposing side walls 86, 87 of the downstream parts 67 define therebetween together with the intervening portions of the upstream part a plurality of further spaced parallel channels 88 which extend across and form parts of the discrete regions. The further channels extend perpendicularly to the channels 80.

The upstanding peripheral wall 70 together with outer facing side walls 89 of the outermost downstream part defines an outermost channel 90 which extends around the flame support adjacent the peripheral wall 70. The upstream part comprises barrier means 91, of similar form to barrier means 75, which extends longitudinally and centrally of the outermost channel for preventing passage of fuel/air mixture issuing into the central portion of the outermost channel 90. To each side of the barrier means 91 the upstream part 66 allows fuel/air mixture to pass from the upstream side thereof by means of burner ports 92, 93, constituting respective passages, which open into the outermost channel at flame support openings 94, 95. These openings are arranged so that when a burner employing this flame support is in use, flames originating or emerging from the openings are directed along portions of the outer side walls 89 of the downstream parts 67 and the opposing sides 70*a* of the peripheral wall 70 in the direction of the mouth of the channel for the same purposes as described above with reference to the FIG. 5 embodiment.

The side walls 78, 79 and 86, 87 and 89 of the downstream parts 67 and the peripheral wall 70 are bevelled as at 78*a*, 79*a*, 86*a*, 89*a*, 87*a* and 70*a* for the same purposes as described above with reference to the FIG. 5 embodiment.

It will be appreciated that the barrier means 75 and 91 and provide lines of land as in earlier embodiments.

The objective of the burner tests carried out by the Applicant was to obtain data to enable the construction of 'combustion diagrams' for the flame supports under examination to determine the performance of the different embodiments.

The combustion diagrams were formed by finding the limiting operating conditions. A satisfactory operating area is limited or bound by:

1. Resonance—failure was when any resonance generated by the combustion process became audible.
2. CO emissions—failure was when the measured CO concentrations were 100 ppm or greater.
3. Flame lift—failure was when the flame began to lift from the burner support surface.
4. Burner overheat—failure was considered to be when parts of the flame support surface began to radiate with a bright yellow appearance.

The test procedure was as follows using different heat input rates. Premixed air and fuel gas were supplied at an aeration of approximately 130%. The aeration was then slowly decreased in stages until resonance, CO emission or burner overheat failure resulted and the aeration was noted. The aeration was then slowly increased in stages until resonance, CO emission or unsatisfactory flame failure resulted and the aeration was again noted.

Line gas G20 (NGA) (what does this definition means exactly?) was used in all the experiments. The heat inputs used were within the range 2 KW (approximately 0.24 $W/mm^2$) to 26 KW (approximately 3 $W/mm^2$) .

Typical results obtained with the flame supports described with reference to FIGS. 2*a,* 3*a* and 4*a* are illustrated in the combustion diagrams in FIGS. 7, 8 and 9, respectively.

Turning firstly to the combustion diagram in FIG. 7 obtained using the plain flame support in FIG. 2*a,* it will be seen that the region associated with satisfactory operation is fairly small and provides a 'baseline' for the modified forms of support shown in FIGS. 3*a* and 4*a*. Satisfactory operation is achieved only for gross port loadings of less than 1 $W/mm^2$ with the burner operating in the radiant mode, and aerations of less than 140%.

The burner resonated at gross port loadings above approximately 1 $W/mm^2$ and at aerations of approximately 120% and below. Thus the burner did not give good results when operating at relatively high heat input levels.

The flame lifts when the flow velocity of the premixture issuing from the ports is faster than the burning velocity of the premixture. In this case the flame lifted at an aeration of approximately 165% at 0.2 $W/mm^2$ gross port loading falling to about 135% at 1.25 $W/mm^2$.

The combustion diagram in FIG. 8 indicates that a significantly larger area of satisfactory operation is available for the flame support shown in FIG. 3*a*.

Resonance occurred at a lower gross port loadings than for the FIG. 2*a* support. Also, resonance occurred at lower aerations as the gross port loading is increased, i.e. as the burner was operated at higher gross port loadings the level of aeration required for resonance to occur fell.

The line of flame lift profile falls from approximately 200% aeration at 0.5 $W/mm^2$ gross port loading to 185% aeration at 2.1 $W/mm^2$.

The combustion diagram in FIG. 9 indicates that an even larger area of satisfactory operation is available for the flame support shown in FIG. 4*a*.

It will be seen that the presence of resonance is substantially reduced. It is believed that the improved resonance performance was a result of the presence of the channels 45 which broke up the continuity of the downstream side of the support.

Although this flame support performed significantly better than the flame support associated with FIG. 8, there were two areas of its performance which the Applicants have improved by modifying the flame support and these modifications have already been described with reference to FIG. 5*a*. The wall or edge at the periphery of the burner provides a hot surface to help anchor or stabilise the flame. Applicants have found that for comparable port loading conditions, when the burner employs the support in FIG. 5*a* in place of the support in FIG. 4*a* there is an improvement in the operation of the burner, in that higher aeration levels can be used before flame lift occurs. Thus the satisfactory operating area is increased.

With the FIG. 4*a* embodiment the areas which were overheating were those edges at the mouths of the channels where the side walls meet the downstream side of the discrete regions. Once these edges were chamfered to produce the bevelled surfaces 54, 56 the very bright glow previously appearing at these edges and associated with overheating of the support material seemed to be eradicated.

In addition it was found that the spacing between the lines of land (or columns of blocked-off holes) could be reduced from 23.1 mm to 21.4 mm to reduce the flame height without significantly increasing the likelihood of resonance occurring.

Tests carried out by the Applicants using the FIG. 4 and 5 embodiments of support in the burner have shown that the burner can achieve a turn-down ratio of 10:1 or greater (0.25 $W/mm^2$ to 2.5 $W/mm^2$ (or higher) gross port loading) even when fitted to a typical domestic boiler, can support a stable flame from aerations from about 110% to 180%, has 3 modes of operation: radiant, transition (a mixture of blue flame and radiant), and blue flame.

In connection with the FIG. 6 embodiment, Applicants investigations indicate that the provision of porous downstream parts enhance the merging of small flames (or flamelets) formed at and supported by the closely spaced very small openings from the pores at or adjacent the surface of the downstream parts at relatively low port loadings or heat inputs into larger flames supported from the downstream parts as a whole at relatively high port loadings and thereby significantly further reduce the likelihood of unwanted resonance occurring during the transition phase of the flamelets into the larger flames.

In addition, as a result of the nature of the porous material of the downstream parts it is envisaged that they can be employed to increase the radiation output of the burner if used partly as a radiant heater.

It will be appreciated that the dimensions and arrangement of the features of the flame support, for a given or intended environment, enclosure or combustion chamber, and composition of fuel gas, are chosen so that the burner can operate as intended, within a given or recommended heat input range for the burner.

It will also be appreciated that whilst particular embodiments have been described above various modifications may be made without departing from the scope of the invention. For example, the further channels 45 (see FIG. 4*d*), 52 (see FIG. 5*d*) and 88 (see FIG. 6*d*) may have barrier means/'lines of land' associated therewith in a similar fashion that channels 33, 51 and 80 have barrier means 35, 56 and 75, respectively, associated therewith. Moreover, although the flame supports and the discrete regions described above and shown in the drawings are rectangular in shape, they may be other shapes, such as circular or round. In such a case, channels and associated barrier means may also be of circular form, with the discrete regions being defined between adjacent channels. Further channels may extend radially through the circular discrete regions.

Also, although the burner ports in the above embodiments are generally of straight cylindrical form end to end, the inlet end portions may be of appropriate converging form and/or the outlet end portions may be of appropriate diverging form in the direction of the downstream side. The provision of such a converging inlet can reduce the formation of eddy currents when the fuel gas/air mixture enters the flame support at the upstream side, whilst the provision of such a diverging outlet, without or without significantly weakening the strength of the support, increases the port area, with the result that there is an increase in port loading and a higher turn down ratio.

I claim:

1. A fuel fired burner comprising:

a chamber for receiving a premixture of fuel and air;

a generally flat flame support extending across the chamber, the flame support having a plurality of discrete regions through which fuel/air mixture can pass from the upstream side of the flame support by means of passages which extend through the flame support to a multiplicity of flame support openings at the downstream side of the flame support, wherein said passages are provided at a substantially uniform spacing within each of said plurality of said discrete regions, the flame support comprising barrier means having a width greater then said uniform spacing which extend longitudinally between the discrete regions with the regions being distanced from each other by a distance greater than said substantially uniform spacing and which prevent the passage of fuel/air mixture from upstream of the support to the downstream side of the support in a region between the discrete regions such that a flow velocity of the fuel/air mixture above said barrier means is substantially reduced;

channel means provided in the surface of the downstream side of the flame support and extending between or defining the boundaries of the discrete regions, and the barrier means preventing the passage of fuel/air mixture from upstream of the support issuing into the central portion of the associated channel means for substantially the whole length of the channel means; and further passages provided in the flame support on each side of each barrier means which open in the channel means at or closely adjacent the respective side wall of the channel means and which are arranged so that, when the burner is in use, flames originating from the further passages provided in the flame support are directed along a portion of the respective side wall in the direction of the mouth of the channel means.

2. A burner as claimed in claim 1, in which the passages comprise substantially equally distributed equi-sized burner ports which extend through the discrete regions.

3. A burner as claimed in claim 2, in which the burner ports extending through the discrete regions are of a circumferentially extending cross-section.

4. A burner as claimed in claim 3, in which the burner ports are substantially circular in cross-section.

5. A burner as claimed in claim 4, in which the burner ports are of substantially straight cylindrical form.

6. A burner as claimed in claim 2, in which the further passages comprise further burner ports.

7. A burner as claimed in claim 6, in which the further burner ports which extend to the channel means are of a circumferentially extending cross-section.

8. A burner as claimed in claim 1, in which the opposite sides of the mouth of the channel means are bevelled.

9. A burner as claimed in claim 1, in which the channel means comprises a plurality of spaced channels extending substantially in parallel.

10. A burner as claimed in claim 9, in which the flame support comprises a plurality of further spaced channels in the downstream side of the flame support, each of the further channels extending through one or more of the discrete regions and transversely to the previously mentioned channels.

11. A burner as claimed in claim 10, in which the opposite sides of the mouth of each further channel are bevelled.

12. A burner as claimed in claim 8, in which the channels and/or the further channels are straight or rectilinear.

13. A burner as claimed in any of the preceding claims, in which an outermost channel means is provided in the surface of the downstream side of the flame support and extends around the flame support so as to lie between outer edges of discrete regions and the peripheral edge of the support, the flame support comprising a barrier means extending longitudinally of the outermost channel means for preventing passage of fuel/air mixture from upstream of the support issuing into the central portion of the outermost channel means, and to each side of the barrier means the flame support allows fuel/gas mixture to pass from the upstream side by means of respective passages which extend through the flame support to flame support openings which open into the outermost channel means and are arranged such that, when the burner is in use, flames originating from these support openings are directed along portions of the respective side walls of the outermost channel means in the direction of the mouth of the channel means, with the inner one of the side wall portions terminating in the outer edges of the discrete regions and the outer one of the side wall portions terminating in the peripheral edge of the flame support.

14. A burner as claimed in claim 13, in which the passages which open into the outermost channel means comprise burner ports.

15. A burner as claimed in claim 14, in which the burner ports extending to the outermost channel means are of a circumferentially extending cross-section.

16. A burner as claimed in claim 13, in which the opposite sides of the mouth of the outermost channels means are bevelled.

17. A fuel fired burner comprising:

a chamber for receiving a premixture of fuel and air;

a generally flat flame support extending across the chamber, the flame support having a plurality of discrete regions through which fuel/air mixture can pass from the upstream side of the flame support by means of passages which extend through the flame support to a multiplicity of flame support openings at the downstream side of the flame support, the flame support comprising barrier means which extend longitudinally between the discrete regions and distance the regions from each other and which prevent the passage of fuel/air mixture from upstream of the support to the downstream side of the support in a region between the discrete regions such that a flow velocity of the fuel/air mixture above said barrier means is substantially reduced;

channel means provided in the surface of the downstream side of the flame support and extending between or defining the boundaries of the discrete regions, and the barrier means preventing the passage of fuel/air mixture from upstream of the support issuing into the central portion of the associated channel means for substantially the whole length of the channel means; and further passages provided in the flame support on each side of each barrier means which open in the channel means at or closely adjacent the respective side wall of the channel means and which are arranged so that, when the burner is in use, flames originating from the further passages provided in the flame support are directed along a portion of the respective side wall in the direction of the mouth of the channel means;

wherein at least portions of the discrete regions forming the flame support openings are comprised of porous material having pores serving as the passages, or portions of the passages, through which the fuel/air mixture can pass to such associated flame support openings.

18. A burner as claimed in claim 17, in which the flame support comprises an upstream part comprising the barrier means, and over at least a portion of one or more of the discrete regions the flame support also comprises an associated downstream part, or respective associated downstream parts, of the porous material, the passages comprising first passage portions constituted by burner ports or through holes extending through the upstream part and second passage portions which comprise pores extending through the porous downstream part or parts, with these pores communicating with associated first passage portions and leading to the flame support openings at the downstream side of the downstream part or respective downstream part.

19. A burner as claimed in claim 18, in which the burner ports or through holes are substantially equi-sized and substantially equally distributed over the upstream part or parts of the discrete regions.

20. A burner as claimed in claim 19, in which the burner ports or through-holes are circular in cross-section.

21. A burner as claimed in any of claims 18 to 20, in which the discrete regions comprise a plurality of said downstream parts having side walls and in which opposing side walls of adjacent spaced apart downstream parts together with the barrier means define a channel between adjacent discrete portions, with the barrier means preventing the passage of fuel/air mixture from upstream of the upstream support part issuing into the central portion of the associated channel for substantially the whole length of the channel.

22. A burner as claimed in claim 17, in which the further passages in the upstream part comprise burner ports or through holes.

23. A burner as claimed in any of claim 21, in which the opposing side walls of the adjacent porous downstream parts are bevelled at the mouth of the channels.

24. A burner as claimed in claim 21, in which the flame support comprises a plurality of barrier means and spaced apart downstream parts so arranged that they define a plurality of spaced channels extending substantially in parallel.

25. A burner as claimed in claim 24, in which other opposing side walls of the plurality of downstream parts define therebetween together with the upstream part a plurality of further spaced channels which extend through or across the discrete regions transversely to the previously mentioned channels.

26. A burner as claimed in claim 25, in which the opposing side walls of the downstream parts defining the further channels are bevelled at the mouth of these channels.

27. A burner as claimed in claim 18, in which the flame support has a peripheral wall which extends around the edge thereof and which together with outer side walls of downstream parts and the upstream part defines an outermost channel means which extends around the flame support, with the upstream part comprising a barrier means extending longitudinally of the outermost channel for preventing passage of fuel/air mixture from upstream of the upstream part issuing into the central portion of the outermost channel means, and to each side of the barrier means the upstream part allows fuel/air mixture to pass from the upstream side of the upstream part by means of respective passages which extend through the upstream part to flame support openings which open into the outermost channel means and are arranged such that, when the burner is in use, flames originating or emerging from these support openings are directed along portions of the said outer side walls of the downstream parts and the peripheral wall in the direction of the mouth of this channel means.

28. A burner as claimed in claim 27, in which the peripheral wall and the outer side walls of the downstream parts defining the outermost channel means are bevelled at the mouth thereof.

29. A burner as claimed in any of claims 1 to 5, in which substantially the whole of the downstream side of the support lies in substantially a common plane.

30. A generally flat flame support for use in a fuel fired burner, the flame support comprising:

a plurality of discrete regions through which fuel/air mixture can pass from the upstream side of the flame support by means of passages which extend through the flame support to a multiplicity of flame support openings at the downstream side of the fame support, wherein said passages are provided at a substantially uniform spacing within each of said plurality of said discrete regions, the flame support comprising barrier means having a width greater than said uniform spacing which extend longitudinally between the discrete regions with the regions being distanced from each other by a distance greater than said substantially uniform spacing and which prevent the passage of fuel/air mixture from upstream of the support to the downstream side of the support in a region between the discrete regions such that a flow velocity of the fuel/air mixture above said barrier means is substantially reduced;

channel means provided in the surface of the downstream side of the flame support and extending between or defining the boundaries of the discrete regions, and the barrier means preventing the passage of fuel/air mixture from upstream of the support issuing into the central portion of the associated channel means for substantially the whole length of the channel means;

further passages provided in the flame support on each side of each barrier means which open in the channel means at or closely adjacent the respective side wall of the channel means and which are arranged so that, when the burner is in use, flames originating from the further passages provided in the flame support are directed along a portion of the respective side wall in the direction of the mouth of the channel means.

31. A flame support as claimed in claim 30, in which the passages comprise substantially equally distributed equi-sized burner ports which extend through the discrete regions.

32. A flame support as claimed in claim 31, in which the burner ports extending through the discrete regions are of a circumferentially cross-section.

33. A flame support as claimed in claim 32, in which the burner ports are substantially circular in cross-section.

34. A flame support as claimed in claim 33, in which the burner ports are of substantially straight cylindrical form.

35. A flame support as claimed in claim 31, in which the further passages comprise further burner ports.

36. A flame support as claimed in claim 35, in which the further burner ports which extend to the channel means have a circumferentially extending cross-section.

37. A flame support as claimed in claim 30, in which the opposite sides of the mouth of the channel means are bevelled.

38. A flame support as claimed in claim 30, in which the channel means comprises a plurality of spaced channels extending substantially in parallel.

39. A flame support as claimed in claim 38, in which the flame support comprises a plurality of further spaced channels in the downstream side of the flame support, each of the further channels extending through one or more of the discrete regions and transversely to the previously mentioned channels.

40. A flame support as claimed in claim 39 in which the opposite sides of the mouth of each further channel are bevelled.

41. A flame support as claimed in claim 38, in which the channels and/or the further channels are straight or rectilinear.

42. A flame support as claimed in claim 30, in which an outermost channel means is provided in the surface of the downstream side of the flame support and extends around the flame support so as to lie between outer edges of discrete regions and the peripheral edge of the support, the flame support comprising a barrier means extending longitudinally of the outermost channel means for preventing passage of fuel/air mixture from upstream of the support issuing into the central portion of the outermost channel, and to each side of the barrier means the flame support allows fuel/gas mixture to pass from the upstream side by means of respective passages which extend through the flame support to flame support openings which open into the outermost channel means and are arranged such that, when the support is located in a burner and the burner is in use, flames originating from these support openings are directed along portions of the respective side walls of the outermost channel in the direction of the mouth of the channel, with the inner one of the side wall portions terminating in the outer edges of the discrete regions and the outer one of the side wall portions terminating in the peripheral edge of the flame support.

43. A flame support as claimed in claim 42, in which the passages which open into the outermost channel means comprise burner ports.

44. A flame support as claimed in claim 43, in which the burner ports extending to the outermost channel means have a circumferentially extending cross-section.

45. A flame support as claimed in any of claims 42 to 44, in which the opposite sides of the mouth of the outermost channel means are bevelled.

46. A generally flat flame support for use in a fuel fired burner, the flame support comprising:

a plurality of discrete regions through which fuel/air mixture can pass from the upstream side of the flame support by means of passages which extend through the flame support to a multiplicity of flame support openings at the downstream side of the flame support, the flame support comprising barrier means which extend longitudinally between the discrete regions and distance the regions from each other and which prevent the passage of fuel/air mixture from upstream of the support to the downstream side of the support in a region between the discrete regions such that a flow velocity of the fuel/air mixture above said barrier means is substantially reduced;

channel means provided in the surface of the downstream side of the flame support and extending between or defining the boundaries of the discrete regions, and the barrier means preventing the passage of fuel/air mixture from upstream of the support issuing into the central portion of the associated channel means for substantially the whole length of the channel means;

further passages provided in the flame support on each side of each barrier means which open in the channel means at or closely adjacent the respective side wall of the channel means and which are arranged so that, when the burner is in use, flames originating from the further passages provided in the flame support are directed along a portion of the respective side wall in the direction of the mouth of the channel means;

wherein at least portions of the discrete regions forming the flame support openings are comprised of porous material having pores serving as the passages, or portions of the passages, through which the fuel/air mixture can pass to such associated flame support openings.

47. A flame support as claimed in claim 46, comprising an upstream part comprising the barrier means, and in which over at least a portion of one or more of the discrete regions the flame support also comprises an associated downstream part, or respective associated downstream parts, of porous material, the passages comprising first passage portions constituted by burner ports or through holes extending through the upstream part and second passage portions which comprise pores extending through the porous downstream part or parts, with these pores communicating with associated first passage portions and leading to the flame support openings at the downstream side of the downstream part or respective downstream part.

48. A flame support as claimed in claim 47, in which the burner ports or through holes are substantially equisized and substantially equally distributed over the up stream part or parts of the discrete regions.

49. A flame support as claimed in claim 48, in which the burner ports or through holes are circular in cross-section.

50. A flame support as claimed in any of claims 47 to 49, in which the discrete regions comprise a plurality of said downstream parts having side walls and in which opposing side walls of adjacent spaced apart downstream parts together with the barrier means define a channel between adjacent discrete portions, with the barrier means preventing the passage of fuel/air mixture from upstream of the upstream support part issuing into the central portion of the associated channel for substantially the whole length of the channel.

51. A flame support as claimed in claim 46, in which the further passages in the upstream part comprise burner ports or through holes.

52. A flame support as claimed in claim 50, in which the opposing side walls of the adjacent porous downstream parts are bevelled at the mouth of the channels.

53. A flame support as claimed in claim 50, in which the flame support comprises a plurality of barrier means and spaced apart downstream parts so arranged that they define a plurality of spaced channels extending substantially in parallel.

54. A flame support as claimed in claim 53, in which other opposing side walls of the plurality of downstream parts define therebetween together with the upstream part a plurality of further spaced channels which extend through or across the discrete regions transversely to the previously mentioned channels.

55. A flame support as claimed in claim 54, in which the opposing side walls of the downstream parts defining the further channels are bevelled at the mouth of these channels.

56. A flame support as claimed in claim 47, in which the flame support has a peripheral wall which extends around the edge thereof and which together with outer side walls of downstream parts and the upstream part defines an outermost channel means which extends around the flame support, with the upstream part comprising a barrier means extending longitudinally of the outermost channel for preventing passage of fuel/air mixture from upstream of the upstream part issuing into the central portion of the outermost channel means, and to each side of the barrier means the upstream part allows fuel/air mixture to pass from the upstream side of the upstream part by means of respective passages which extend through the upstream part to flame support openings which open into the outermost channel means and are arranged such that, when flame support is located in a burner and the burner is in use, flames originating or emerging from these support openings are directed along portions of the said outer side walls of the downstream parts and the peripheral wall in the direction of the mouth of this channel means.

57. A flame support as claimed in claim 56, in which the peripheral wall and the outer side walls of the downstream parts defining the outermost channel means are bevelled at the mouth thereof.

58. A flame support as claimed in any of claims 30 to 34, in which substantially the whole of the downstream side of the support lies in substantially a common place.

59. A fuel fired burner comprising:

a chamber for receiving a premixture of fuel and air;

a generally flat flame support extending across the chamber, the flame support having a plurality of discrete regions through which fuel/air mixture can pass from the upstream side of the flame support by means of passages which extend through the flame support to a multiplicity of flame support openings at the downstream side of the flame support, wherein said passages are provided at a substantially uniform spacing within each of said plurality of said discrete regions, the flame support comprising at least one barrier which extends longitudinally between the discrete regions with the regions being distanced from each other by a distance greater than said substantially uniform spacing and which prevent the passage of fuel/air mixture from upstream of the support to the downstream side of the support in a region between the discrete regions such that a flow velocity of the fuel/air mixture above said at least one barrier is substantially reduced;

at least one channel provided in the surface of the downstream side of the flame support and extending between or defining the boundaries of the discrete regions, and the barrier preventing the passage of fuel/air mixture from upstream of the support issuing into the central portion of the associated channel for substantially the whole length of the channel; and further passages provided in the flame support on each side of each barrier which open in the channel at or closely adjacent a respective side wall of the channel and which are arranged so that, when the burner is in use, flames originating from the further passages provided in the flame support are directed along a portion of the respective side wall in the direction of the mouth of the channel.

60. A generally flat flame support for use in a fuel fired burner, the flame support comprising:

a plurality of discrete regions through which fuel/air mixture can pass from the upstream side of the flame support by means of passages which extend through the flame support to a multiplicity of flame support openings at the downstream side of the fame support, wherein said passages are provided at a substantially uniform spacing within each of said plurality of said discrete regions, the flame support comprising at least one barrier which extend longitudinally between the discrete regions and distance the regions from each other by a distance greater than said substantially uniform spacing and which prevent the passage of fuel/air mixture from upstream of the support to the downstream side of the support in a region between the discrete regions such that a flow velocity of the fuel/air mixture above said at least one barrier is substantially reduced;

at least one channel provided in the surface of the downstream side of the flame support and extending between or defining the boundaries of the discrete regions, and the barrier preventing the passage of fuel/air mixture from upstream of the support issuing into the central portion of the associated channel for substantially the whole length of the channel; and further passages provided in the flame support on each side of each barrier means which open in the channel means at or closely adjacent a respective side wall of the channel means and which are arranged so that, when the burner is in use, flames originating from the further passages provided in the flame support are directed along a portion of the respective side wall in the direction of the mouth of the channel means.

* * * * *